United States Patent [19]

de Ronde

[11] Patent Number: 4,890,117

[45] Date of Patent: Dec. 26, 1989

[54] ANTENNA AND WAVEGUIDE MODE CONVERTER

[75] Inventor: Frans C. de Ronde, Bath, England

[73] Assignee: National Research Development Corporation, London, England

[21] Appl. No.: 143,811

[22] Filed: Jan. 14, 1988

[30] Foreign Application Priority Data

Jan. 20, 1987 [GB] United Kingdom ..... 8701197

[51] Int. Cl.[4] ..... H01Q 13/04

[52] U.S. Cl. ..... 343/773; 343/828; 333/21 R

[58] Field of Search ..... 343/786, 773, 774, 775, 343/771, 828, 834; 333/21 R, 21 A, 248, 251

[56] References Cited

U.S. PATENT DOCUMENTS

| | | | |
|---|---|---|---|
| 2,471,021 | 5/1949 | Bradley | 333/21 R |
| 2,954,558 | 9/1960 | Honey et al. | 333/21 R |
| 3,375,474 | 3/1968 | Thompson et al. | 333/21 R |
| 3,605,099 | 9/1971 | Griffith | 343/771 |
| 4,041,499 | 8/1977 | Liu et al. | 343/786 |
| 4,143,377 | 3/1979 | Salvat et al. | 343/783 |

FOREIGN PATENT DOCUMENTS

| | | | |
|---|---|---|---|
| 529539 | 11/1940 | United Kingdom . | |
| 548193 | 9/1942 | United Kingdom | 343/773 |
| 657757 | 9/1951 | United Kingdom . | |
| 749303 | 5/1956 | United Kingdom . | |
| 1145507 | 3/1969 | United Kingdom . | |

*Primary Examiner*—Rolf Hille
*Assistant Examiner*—Michael C. Wimer
*Attorney, Agent, or Firm*—Cushman, Darby & Cushman

[57] ABSTRACT

In view of the introduction of cellular radio, there is a requirement for an antenna of simple construction which can be sold in a consumer market. While the invention meets this need it also has application to the problem of providing $TM_{01}$ to $TE_{01}$ made converters. The invention employs radial conductors printed on a dielectric substrate and aligned with the transverse electric field in a waveguide supporting the $TM_{01}$ mode. Circumferential conductors, each coupled to one of the radial conductors, act as monopoles radiating the required field in an antenna where the radial conductors project through apertures in the waveguide. For the mode converter, both radial and circumferential conductors are inside the waveguide, with the radial conductors aligned with the transverse electric field of the $TM_{01}$ mode. Arrangements for maximizing the field at the position of the radial and circumferential conductors are described as are means for preventing the propagation of unwanted modes.

15 Claims, 5 Drawing Sheets

$TM_{01}$ $TE_{02}$

ANTENNA AND WAVEGUIDE MODE CONVERTER

BACKGROUND OF THE INVENTION

The present invention relates to mode converters. it is particularly useful for $TM_{01}$ $TE_{01}$ conversion in a circular waveguide and in a type of biconical horn antenna radiating a horizontally polarised electric field.

For many future applications such as cellular radio at 60 GHz, omnidirectional antennas with horizontal polarisation are required. Since such uses are in mass markets, these antenna are preferably of simple construction so that they can be manufactured at a low price.

At a present biconical horn antennas are excited by the $TE_{01}$ mode through a transverse slot in a circular waveguide. Problems arise in the excitation of the $TE_{01}$ mode either by direct means or by way of a mode converter excited in a more simple mode, such as the $TE_{10}$ mode in a rectangular waveguide. Moreover, as far as $TM_{01}$ to $TE_{01}$ mode converters are concerned, it is no easy to excite the $TE_{01}$ mode in a circular waveguide and it is especially difficult for millimeter waves where dimensions are very small.

SUMMARY OF THE INVENTION

According to a first aspect of the present invention there is provided a mode converter for converting between first and second modes, the mode converter comprising a plurality of pairs of elongated coupling elements in a plane at right angles to the longitudinal axis of a waveguide, at least one element of each pair being free to interact with an electromagnetic field within the waveguide, each element being formed by a conductor which is substantially aligned in the plane with the electric field of one of the modes, or a slot, in a conducting surface, which is substantially normal to the electric field, each pair of elements comprising at first element which is aligned with or normal to the electric field of the first mode, and a second element which is aligned with or normal to the electric field of the second mode, one end of the first element of each pair being adjacent to, but not necessarily joined to, the second element of each pair, and each second element forming a monopole with no corresponding element in the mode converter forming a dipole with that second element.

The main advantage of the first aspect of the invention is that it provides an effective basic mode converter while employing a simple construction. Usually, however, further parts are required in order to provide good performance. The construction is simplified by using only monopoles since interconnections are fewer and no baluns are required. In addition, a more uniform omnidirectional radiation pattern can be achieved since the distance between current maxima in antenna elements, for example, can be closer.

According to a second aspect of the invention there is provided an antenna comprising a mode converter according to the first aspect wherein the waveguide has a cross-section which is circular or in the form of a substantially regular polygon, the first and second elements of each pair are first and second conductors, respectively, the first conductors being mainly within the waveguide but projecting through apertures in the wall thereof, and the second conductors being outside the wall.

Preferably the antenna includes two facing conducting conical surfaces located outside the waveguide, one on either side of the second conductors. In addition, the waveguide is preferably short circuited for the $TM_{01}$ mode on one side of the first conductors at a distance of substantially equal to a quarter of the guide wavelength for the $TM_{01}$ mode in the waveguide. As will be appreciated, with these additions the second aspect of the invention provides an economical but efficient omnidirectional biconical horn antenna.

According to a third aspect of the present invention there is provided a converter for conversion between waveguide modes, the converter comprising a mode converter according to the first aspect wherein the first and second elements of each pair are first and second conductors, respectively, inside the waveguide.

Preferably the mode converter includes at least one, but preferably both, of the following mode selective short circuits: a short circuit for the $TM_{01}$ mode, and a short circuit for a mode having an electric field parallel to the second elements at least in a region thereof; each short circuit being positioned on one side of the plane containing the coupling elements at a distance equal to a quarter of a guide wavelength for the mode which it reflects from the plane. Where both mode selective short circuits are provided they are positioned on opposite sides of the plane. The first and second conductors may be "printed" conductors on a dielectric disc. Also, the first short circuit preferably comprises radial conductors and the second short circuit preferably comprises circular conductors with the conductors of both short circuits also "printed" on respective dielectric discs.

The advantage of this construction is that it can be made economically because the main body of the converter has a rotational symmetry, and the critical parts such as the first and second conductors and the mode selective short circuits can be realised in planar technology by photolithographic means. The dimensions of a coaxial input line connected to the converter can be made much larger than usual (that is rather large for a millimetre waveguide) if it forms a coupling between a rectangular waveguide and the waveguide containing the mode converter. The coaxial line then has a higher impedance than usual and it is much easier to provide matching over the full waveguide band. Moreover, the coaxial line can be kept very short thus reducing losses and making it easier to realise.

According to a fourth aspect of the invention there is provided a converter for conversion between waveguide modes, the converter comprising a mode converter according to the first aspect wherein the first and second elements of each pair are slots in a conducting surface at the end of the waveguide, and the converter including a further waveguide having one end adjacent to the end and a further conducting surface separated from the other conducting surface and shielding the second elements from the further waveguide.

The invention also includes methods corresponding to the various aspects mentioned above.

BRIEF DESCRIPTION OF THE DRAWINGS

Certain embodiments of the invention will now be described by way of example with reference to the accompanying drawings, in which.

DETAILED DESCRIPTION OF THE PREFERRED EMBODIMENTS

Figure 1A:
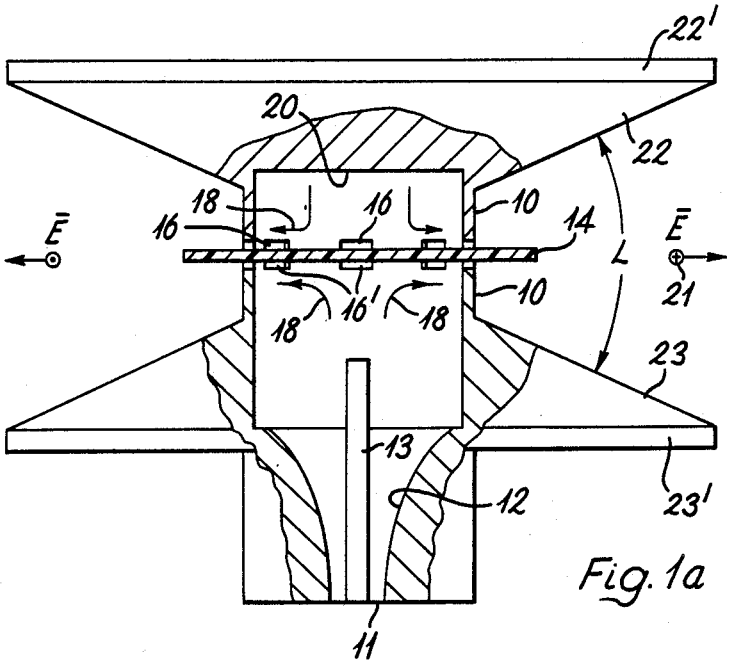
FIG. 1*a* is a partial cross-section of a biconical horn antenna according to the invention.

In FIG. 1*a* a $TM_{01}$ wave is excited in a circular waveguide 10 by means of a coaxial line 11 connected to the waveguide 10 by way of a tapered transition 12 and a probe 13 which is an extension of the centre conductor of the coaxial line 11. The taper 12 allows a pure $TM_{01}$ mode to be obtained with hardly any reflection over the whole of the waveguide band, for example, from 8.2 to 12.4 GHz. In order to make matching comparatively easy the dimensions of the coaxial line are such that it has a high impedance, for example, much greater than 50 Ohms.

Figure 1B:
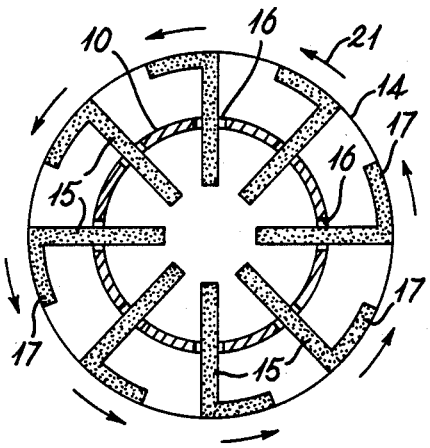
FIGS. 1*b* and 1*c* are views of a disc supporting radial and arcuate conductors, and showing the relationship of waveguide wall slots

A thin dielectric disc 14 (see FIGS. 1*a* and 1*b*) is mounted transverse to the waveguide 10 and carries radial conductors 15 which project through small slots 16 through the walls of the waveguide 10. The radial conductors are connected to arcuate radiating conductors 17 located outside the waveguide 10. Each radial conductor 15 and each arcuate conductor 17 together form a pair of coupling elements. The total length of each pair of radial and arcuate conductors may be, but preferably is not, a resonant length. Thus, each such pair is preferably shorter in total length than half a free space wavelength. The conductors 15 and 17 are not shown in FIG. 1a because they are thin relative to the thickness of the disc 14, but the disc 14, should be as thin as possible to prevent vertical polarisation in the gap in the waveguide wall where the disc is located. For this reason the disc should be thin and not made of a dielectric material which is too lossy, and it is also important that this gap is in the plane of maximum electric field. Thus, a low price printed circuit film is suitable.

The antenna functions by making a transformation from the $TM_{01}$ mode to an equivalent of the $TE_{01}$ mode but outside the waveguide using the radial conductors 15 and the arcuate conductor 17. As shown in FIG. 1a, the electric field 18 of the $TM_{01}$ mode is parallel to the radial conductors 15 where it is at a maximum, thereby causing currents to be induced in the radial conductors. In order to ensure that a maximum in the electric field occurs in the plane of the disc 14, the waveguide is short-circuited at 20, the distance between the short-circuit 20 and the disc 14 being approximately a quarter of a guide wavelength for the $T_{01}$ mode. The position of the short-circuit 20 may be determined using the full band matching technique described in U.S. application Ser. No. 07/055,131 lcorresponding to British Patent Application No. 8613028 (de Ronde). The currents induced in the radial conductors 15 cause currents to flow in the arcuate conductors 17 so that they radiate with horizontal polarisation as indicated at 21 in FIGS. 1*a* and 1*b*. Since the conductors provide currents around nearly the whole circle, the radiation pattern is substantially independent of angle in the horizontal plane.

Two conducting conical surfaces 22 and 23 are positioned on either side of the conductors 17 as an aid to bunching the beam so that it spreads only a limited amount vertically. Thus, the surfaces function as reflectors for reducing the divergence of waves radiated by the antenna. The cut-off frequency of this part of the antenna is determined by the length L shown in FIG. 1*a*. As indicated in FIG. 1*a* by slots 16' corresponding to the slots 16, the radial and arcuate conductors 15 and 17 may with advantage be duplicated so that corresponding conductors appear on both sides of the dielectric disc 14. The gap in which the disc 14 is located does not perturb the currents in the waveguide because it is positioned a quarter of a guide wavelength from the short circuit at 20. The upper and lower parts of the antenna as divided by the disc are held together by a thin dielectric cylinder (not shown) fitting round edges 22' and 23' of the surfaces 22 and 23.

Figure 1C:
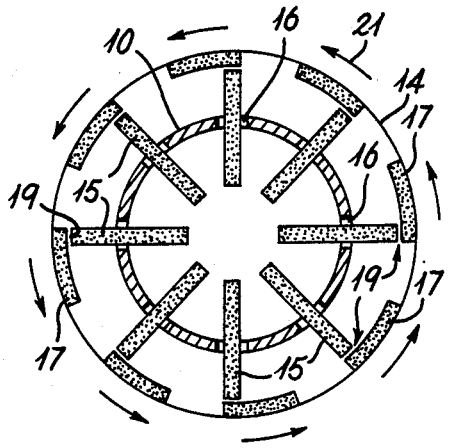

This form of the invention can be put into practice in many other ways, for example, the coupling between each radial conductor 15 and its associated arcuate conductor 17 may be capacitive (for example by means of a small gap 19 between the end of each conductor 15 and the corresponding conductor 17 as shown in FIG. 1*c*). The coaxial input may well be suitable for direct connection to an integrated circuit using microstrip or stripline.

Figure 2A:
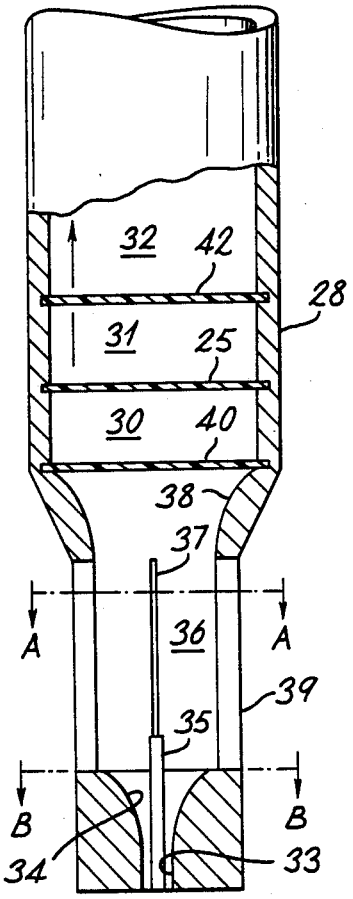
FIG. 2*a* is a longitudinal cross-section of a mode converter according to the invention.

The same principle of conversion from the $TM_{01}$ mode to the $TE_{01}$ mode is used in the mode converter shown in FIG. 2*a*.. A dielectric disc 25 (see FIG. 2d) carries coupling elements formed by pairs of radial conductors 26 coupled to arcuate conductors 27 and is positioned inside a waveguide 28.

Figure 2B:
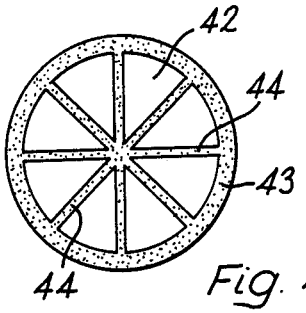
FIGS. 2*b* and 2*c* show planar discs mounting conductors to form mode-selective short circuits in the converter of FIG. 2*a*, FIGS. 2*d* and 2*e* show planar discs mounting conductors forming the coupling elements of the invention.
Figure 2C:
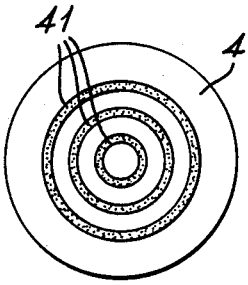
Figure 2D:
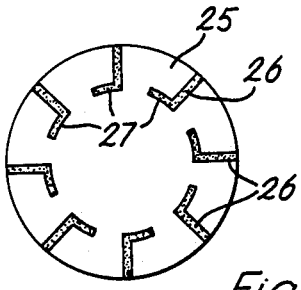
FIGS. 2*f* and 2*g* show cross-sections of the converter of FIG. 2*a* in the planes A—A and B—B, respectively.

In operation, the $TM_{01}$ mode is excited in a region 30 of the waveguide 28 and is converted by the conductors on the disc 25 to the $TE_{01}$ mode in the regions 30, 31 and 32 of the waveguide so that this mode exits from the waveguide. The $TM_{01}$ mode is excited by a TEM mode which emerges from a coaxial line 33 and then passes through a gradual transition 34 having a probe 35 (FIG. 2g) extending from the centre conductor of the coaxial line. As a result, the $TM_{01}$ mode is set up in a region 36 inside a waveguide section 39, but since the $TE_{11}$ mode may be excited fairly easily by minor asymmetry, the section 39' has at least four longiudinal slots 37 equally spaced around its periphery as shown in FIG. 2f. These slots tend to attenuate the TE11 mode and may be resonant in order to increase their effect.

To allow the $TE_{01}$ mode to propagate in the area of the disc 25, the diameter of the waveguide 28 has to be made larger than that for the region 36, this enlargement being achieved by means of a taper 38. A mode-selective short circuit in the form of a dielectric disc 40 carrying circular conductors 41 (FIG. 2c) is positioned approximately a quarter of a guide wavelength for the $TE_{01}$ mode away from the disc 25 in the direction of the $TM_{01}$ mode waveguide. Similarly, another mode selective short-circuit formed by the dielectric disc 42 bearing a circumferential conductor 43 and radial conductors 44 (FIG. 2b) is positioned approximately a quarter of a guide wavelength in the $TM_{01}$ mode from the disc 25, but on the other side. Positioning the mode selective short circuits in this way provides good excitation for the radial conductors 26 on the disc 25 because the TM01 mode is short-circuited by the conductors 44 on the disc 42, and similarly, the $TE_{01}$ mode is short-circuited by the conductors 41 on the disc 40. Both the conductors 41 and 44 are approximately a quarter of a guide wavelength for their respective modes from the radial conductors 26, and therefore the conductors 26 are in a position of maximum electric field strength. Again the full band matching technique of the abovementioned patent application may be used to position the discs 40 and 42.

The conductors 41 reflect the $TE_{01}$ mode, and in addition, the diameter of the waveguide section 39 does not allow the $TE_{01}$ mode to propagate towards the coaxial line 33. The $TM_{01}$ is prevented from propagating towards the output of the converter (the upper end of the waveguide 28 as seen in FIG. 2a) by the mode-selective short circuit formed by the conductors 43 and 44.

Although it would be possible to position the discs 40 and 42 at other odd numbers of quarter guide wavelengths from the disc 25, there is a small risk that higher order modes may be excited in the regions 30 and 31, especially since the arcuate conductors 27 disturb the symmetry of the guide. For this reason the distance between the discs 40 and 42 should be kept as short as possible, for example, as suggested at approximately half the guide wavelength. Again the arcuate conductors 27 may be capacitively coupled to the radial conductors 26.

The mode converter of FIG. 2*a* has been found to be easily excited over the waveguide band of 8.2 to 12.4 GHz and provides a substantially pure $TE_{01}$ mode propagation for the output end of the waveguide 28.

Figure 2E:
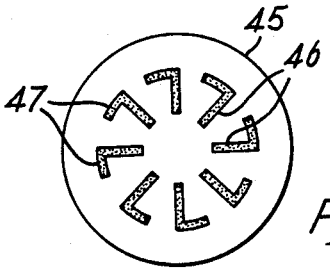
Figure 2F:
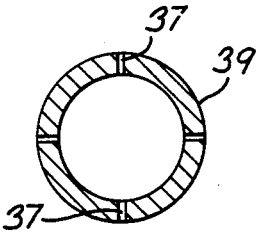
Figure 2G:
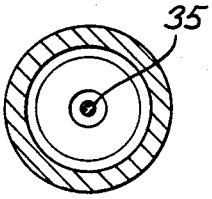

The disc 25, and the conductors 26 and 27 may be replaced by a disc 45, and the conductors 46 and 47 shown in FIG. 2*e*. The arcuate conductors may be straight and at right angles to the radial conductors.

Figure 3:
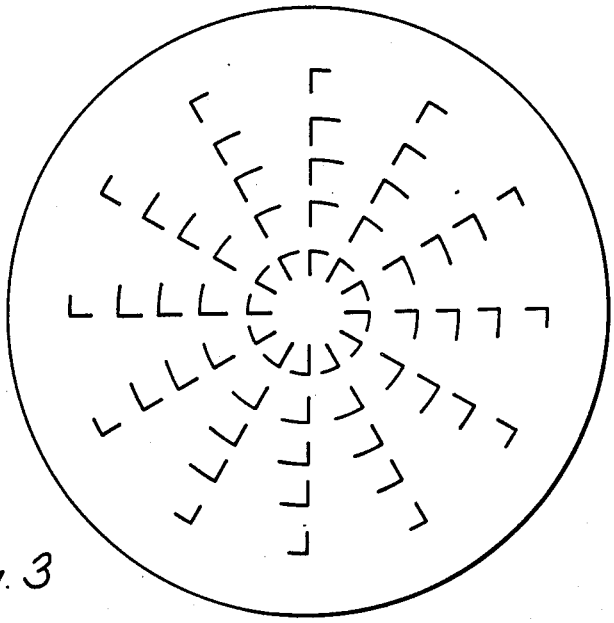
FIG. 3 shows a planar disc mounting a plurality of pairs of coupling elements arranged in circles.

FIG. 3 shows an alternative arrangement of pairs of coupling elements to those shown in FIGS. 2*d* and 2*e*, the arrangement of FIG. 3, being suitable to replace the disc 25. In FIG. 3 the radial and arcuate conductors are mounted on a dielectric disc and represented by single lines. The conductors are arranged in circular groups about the centre of the disc with the lengths of the arcuate conductors proportional to the electric field strength of the $TE_{01}$ mode.

Figure 4A:
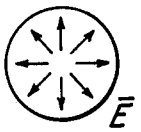
FIGS. 4*a* and 4*c* show coupling elements and electric fields for conversion from the $TM_{01}$ to the $TE_{02}$ mode.
Figure 4B:
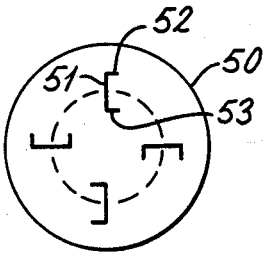
Figure 4C:
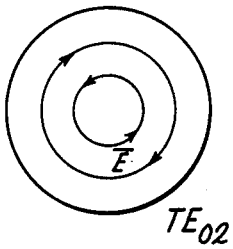

In order to form a $TM_{01}$ to $TE_{02}$ mode converter with the arrangement of FIG. 2*a*, the disc 25 is replaced by the disc 50 shown in FIG. 4*b*. Each coupling element comprises a radial conductor such as the conductor 51 and two conductors such as 52 and 53 at right angles thereto. FIG. 4*b* includes a dashed circle to indicate the relative position of the $TM_{01}$ waveguide section. When the electric field of the $TM_{01}$ mode (see FIG. 4*a*) induces a current in the radial conductors, currents in opposite directions are induced in the conductors at right angles thereto, and these currents conform with the electric field of the $TE_{02}$ mode as shown in FIG. 4*c*. For a $TM_{01}$ to $TE_{02}$ mode converter, the short circuits provided by the conductors on the discs 40 and 42 remain in place.

Figure 5:
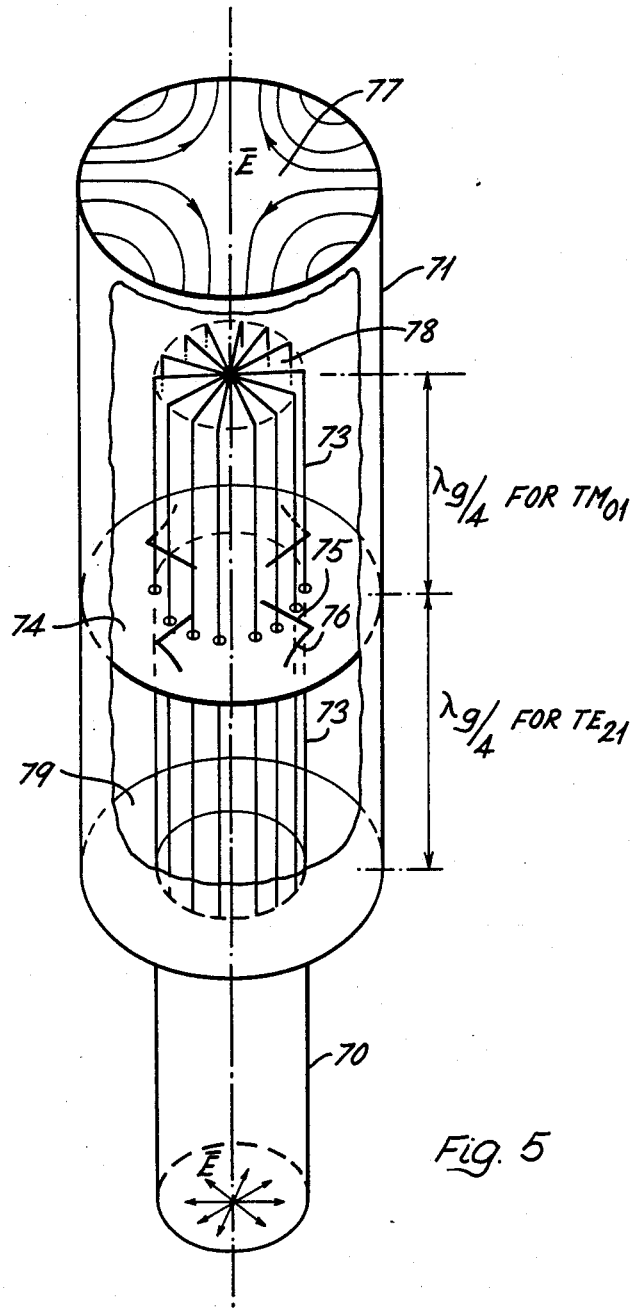
FIG. 5 illustrates a $TM_{01}$ to $TE_{21}$ mode converter according to the invention.

FIG. 5 shows a $TM_{01}$ to $TE_{21}$ mode converter, in which a waveguide 70 carries the $TM_{01}$ mode and a waveguide 71 of larger diameter carries the $TE_{21}$ mode. A cage 73 of conductors extends from the waveguide 70 and supports the $TM_{01}$ mode without providing any support for the $TE_{21}$ mode. A dielectric disc 74 carries radial conductors, such as the conductor 75, and curved conductors, such as the conductor 76, which conform to the electric field of the $TE_{21}$ mode as indicated at 77. As before, currents are induced in the radial conductors by the electric field of the $TM_{01}$ mode and the resulting currents in the curved conductors induce portions of the required $TE_{21}$ mode. The end 78 of the cage 73 forms a short circuit for the $TM_{01}$ mode and is positioned approximately a quarter of a guide wavelength from the disc 74. The waveguide 70 is below cut off of the $TE_{21}$ mode, so this mode cannot propagate into the waveguide 70. A conducting step 79 and the waveguide 70 form a short circuit for the $TE_{21}$ mode which is located approximately a quarter of a guide wavelength from the disc 74.

Figures 6A, 6B, 6C:
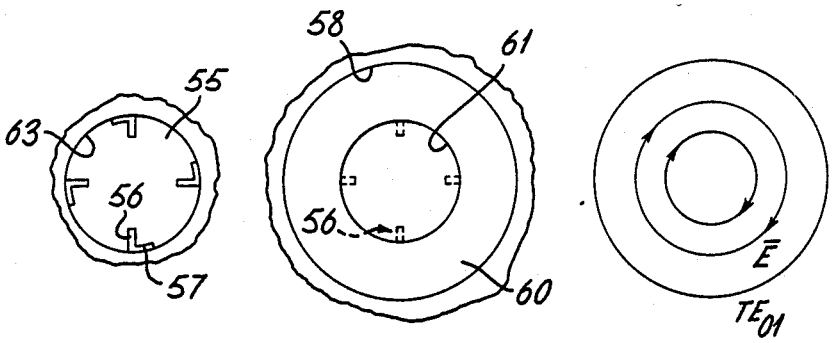
FIGS. 6*a* to 6*c* show coupling elements in a conducting surface for conversion from the $TM_{01}$ mode to the $TE_{01}$ mode.
Figure 6D:
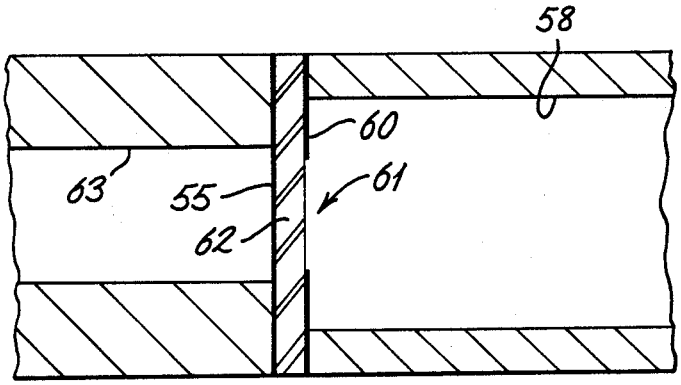
FIG. 6*d* is a longitudinal cross-section of a mode converter using the slots of FIGS. 6*a* and 6*b*.

In the $TM_{01}$ to $TE_{01}$ mode converter of FIGS. 6*a* to 6*d* the conducting coupling elements are replaced by coupling slots in a conducting disc 55 which is seen in FIG. 6*a* through a waveguide 63 which propagates the $TM_{01}$ mode. Each pair of coupling elements comprises a radial slot and an arcuate slot, for AC, slots 56 and 57, respectively. The radial electric field of the $TM_{01}$ mode as shown in FIG. 4*a* excites potentials across the arcuate slots which cause currents to flow along the sides of the radial slots. These currents induce potentials across the radial slots in the direction of the electric field of the $TE_{01}$ mode as shown in FIG. 6*c*. Thus, the $TE_{01}$ mode is excited in a waveguide 58, but in order to prevent the arcuate slots from inducing a radial field in the waveguide 58, the arcuate slots are masked from the waveguide 58 by a conducting disc 60 having a large central aperture 61. The shielding provided by the disc 60 is indicated by FIG. 6*b* which shows the view along the waveguide 58 towards the disc 60. The discs 55 and 60 are separated by a dielectric disc 62 (FIG. 6*d*) having a thickness which allows the impedance of the arcuate slot to be reasonably high.

It will be apparent from the above that the invention may be put into practice in many different ways from those specifically shown. In particular, the distances of the short circuits from the radial conductors may be varied, for example, by using odd multiples of the quarter guide wavelengths mentioned. Also, other types of mode selective short circuits and, in the case of the horn antenna, reflectors, may be used provided that the arrangement of radial and arcuate conductors is employed.

Although the mode converters are described as converting from a first mode to a second mode, they may be used, as is well known, in the reverse sense to convert from the second mode to the first. Equally the antenna of the invention may be used for reception as an alternative to transmission.

I claim:

1. An antenna comprising:

a waveguide which propagates waves along an axis thereof in a $TM_{01}$ mode; and a plurality of pairs of elongated coupling elements in a plane at right angles to the axis of the waveguide, each pair of elements comprising a first conducting element partly within the waveguide and aligned with an electric field of the $TM_{01}$ mode, and a second conducting element external to the waveguide which is aligned with a required external electric field of the antenna, one end of the first element of each pair extending through an aperture in the waveguide so as to be adjacent to one end of the second element of that pair, and each second element forming a monopole with no corresponding element of the antenna forming a dipole with that second element.

2. An antenna according to claim 1, wherein the waveguide has a cross-section which is circular and each first element projects through a respective aperture in a wall of the waveguide.

3. An antenna according to claim 2, further including two conducting surfaces located outside the waveguide, one on one side of the second elements and the other conducting surface on the opposite side of the second elements, the surfaces being shaped to form reflectors so as to reduce the divergence of waves radiated from the second elements.

4. An antenna according to claim 3, wherein each said conducting surface is conical.

5. An antenna according to claim 2 further including a short circuit for the $TM_{01}$ mode on one side of the first conducting elements at a distance approximately equal to an odd number of quarter guide wavelengths for the $TM_{01}$ mode in the waveguide.

6. An anenna according to claim 1, wherein the adjacent ends of the first element and the second element of each pair are not joined but are coupled electromagnetically.

7. An antenna according to claim 1, wherein the waveguide has a cross-section which is in the form of a substantially regular polygon and each first element projects through a respective aperture in a waveguide wall.

8. An antenna according to claim 1, wherein the adjacent ends of the first element and the second element of each pair are joined conductively.

9. A mode converter for converting between $TM_{01}$ and $TE_{01}$ modes, comprising:

a waveguide having an axis and a waveguide wall around the inside of the waveguide;

a conducting surface substantially at right angles to the axis of the waveguide, the surface making contact with said waveguide wall; and a plurality of pairs of elongated coupling elements formed as slots in said conducting surface, each pair of elements comprising a first element which is parallel to a magnetic field of the $TM_{01}$ mode, and a second element which is parallel to a magnetic field of the $TE_{01}$ mode, one end of the first element of each pair being coupled to one end of the second element of that pair.

10. A mode converter according to claim 9, wherein said mode converter further includes a second waveguide positioned end to end with said waveguide, with the first and second elements of each pair being between the waveguides.

11. A mode converter according to claim 9, further including a coaxial line coupled to the waveguide by means of a circularly tapered transition and a probe extending from a centre conductor of the coaxial line.

12. A mode converter according to claim 9, wherein the conducting surface is positioned at the end of the waveguide, and the converter includes a further waveguide having one end adjacent to said waveguid end and a further conducting surface separated from the other conducting surface and shielding the second elements from the further waveguide.

13. A mode converter according to claim 9, wherein the second elements are outside the waveguide.

14. A mode converter for converting between $TM_{01}$ and $TE_{01}$ modes, comprising:

a waveguide having an axis and a waveguide wall around the inside of the waveguide;

a conducting surface which makes contact with said waveguide wall; and a plurality of pairs of elongated coupling elements in a plane at right angles to the axis of the waveguide, each element being formed by a slot in said conducting surface, each pair of elements comprising a radial first element which is spaced radially from the first elements of other pairs about the point of intersection between said plane and said axis, and a second element which with the first element forms an "L" shape, one end of the first element of each pair being coupled to one end of the second element of that pair.

15. An antenna comprising:

a waveguide which propagates waves along an axis thereof in a $TM_{01}$ mode; and a plurality of pairs of elongated coupling elements in a plane at right angles to the axis of the waveguide, one element of each pair being aligned with an electric field of the $TM_{01}$ mode of the waveguide and each element being formed by a conductor, each pair of elements comprising a first element which is partially within the waveguide and is spaced radially from the first elements of the other pairs about the point of intersection between the plane and the axis, and a second element outside the waveguide which with the first element forms an "L" shape, one end of the first element of each pair being adjacent to one end of the second element of that pair, and each second element forming a radiating monopole with no corresponding element of the antenna forming a dipole with that second element.

* * * * *